US010271669B2

(12) United States Patent
Alletto, Jr.

(10) Patent No.: US 10,271,669 B2
(45) Date of Patent: Apr. 30, 2019

(54) PILLOW WITH GUSSET AND OPEN CELL CONSTRUCTION

(71) Applicant: BEDGEAR, LLC, Farmingdale, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 46 days.

(21) Appl. No.: 15/602,870

(22) Filed: May 23, 2017

(65) Prior Publication Data

US 2017/0251842 A1 Sep. 7, 2017

Related U.S. Application Data

(63) Continuation of application No. 15/362,285, filed on Nov. 28, 2016, now Pat. No. 9,895,011, and a continuation of application No. 14/698,441, filed on Apr. 28, 2015, which is a continuation of application No. 14/328,008, filed on Jul. 10, 2014, now Pat. No. 9,015,883, which is a continuation of application No. 14/107,665, filed on Dec. 16, 2013, now Pat. No. 8,887,332, which is a continuation of application No.

(Continued)

(51) Int. Cl.
*A47G 9/10* (2006.01)

(52) U.S. Cl.
CPC ..... *A47G 9/1036* (2013.01); *A47G 9/10* (2013.01); *A47G 9/1054* (2013.01); *A47G 2009/1018* (2013.01)

(58) Field of Classification Search
CPC ..... A47G 9/1036; A47G 9/1054; A47G 2009/1018; A47G 9/10
USPC ..... 5/636
See application file for complete search history.

(56) References Cited

U.S. PATENT DOCUMENTS

| | | | |
|---|---|---|---|
| 1,212,515 | A | 1/1917 | Leavitt |
| 1,876,591 | A | 9/1932 | Bawden |
| 2,128,978 | A | 9/1938 | Akin |

(Continued)

FOREIGN PATENT DOCUMENTS

| | | |
|---|---|---|
| AU | WO2010/006372 | 1/2010 |
| EP | 1222886 A2 | 7/2002 |

(Continued)

OTHER PUBLICATIONS

International Search Report and Written Opinion of the International Search Authority dated Apr. 6, 2010 in International Application No. PCT/US2009/069018 (WO2010075294), Applicants: Tempur-Pedic Management, Inc.

(Continued)

*Primary Examiner* — Eric J Kurilla
(74) *Attorney, Agent, or Firm* — Sorell, Leanna & Schmidt, LLP

(57) ABSTRACT

A pillow is provided herein which includes a cover having opposing first and second panels. A gusset perimetrically bounds, and joins, the first and second panels. The gusset is formed of an open cell construction. Compliant fill material is disposed within the cover. Advantageously, with the subject invention, a pillow is provided allowing for lateral ventilation between opposing panels. This permits a cooling effect while a user is resting or sleeping.

20 Claims, 4 Drawing Sheets

Related U.S. Application Data

13/531,122, filed on Jun. 22, 2012, now Pat. No. 8,646,134.

(60) Provisional application No. 61/499,907, filed on Jun. 22, 2011.

(56) References Cited

U.S. PATENT DOCUMENTS

| | | | |
|---|---|---|---|
| 2,566,790 | A | 9/1951 | Bloomfield |
| 2,765,480 | A | 10/1956 | Mueller |
| 2,784,420 | A | 3/1957 | Moltane |
| 2,927,331 | A | 3/1960 | Ruiz |
| 3,103,669 | A | 9/1963 | Mundis |
| 3,109,182 | A | 11/1963 | Doak |
| 3,183,527 | A | 5/1965 | Turner |
| 3,438,069 | A | 4/1969 | Harold |
| 3,521,310 | A | 7/1970 | Greenawalt |
| 3,616,470 | A | 11/1971 | Young |
| 3,882,871 | A | 5/1975 | Taniguchi |
| 4,232,415 | A | 11/1980 | Webber |
| 4,280,342 | A | 7/1981 | Eng et al. |
| 4,370,765 | A | 2/1983 | Webber |
| 4,644,591 | A | 2/1987 | Goldberg |
| 4,665,575 | A | 5/1987 | Raught |
| 4,767,419 | A | 8/1988 | Fattore |
| 4,903,357 | A | 2/1990 | Kruchen et al. |
| 4,922,565 | A | 5/1990 | Blake |
| 5,010,611 | A | 4/1991 | Mallett |
| 5,086,530 | A | 2/1992 | Blake |
| 5,148,564 | A | 9/1992 | Reder |
| 5,385,036 | A | 1/1995 | Spillane et al. |
| 5,509,157 | A | 4/1996 | Story |
| 5,566,407 | A | 10/1996 | Lien |
| 5,575,025 | A | 11/1996 | Peters |
| 5,577,276 | A | 11/1996 | Nicholson et al. |
| 5,642,543 | A | 7/1997 | Huntley |
| 5,642,545 | A | 7/1997 | Howard |
| 5,699,571 | A | 12/1997 | Yowell |
| 5,706,534 | A | 1/1998 | Sherman |
| D394,366 | S | 5/1998 | Graebe et al. |
| D396,981 | S | 8/1998 | Laidlaw |
| 5,787,534 | A | 8/1998 | Hargest et al. |
| 5,806,112 | A | 9/1998 | Harms |
| 5,855,031 | A | 1/1999 | Swift, Jr. |
| 5,857,232 | A | 1/1999 | Mahdavi |
| 5,881,408 | A | 3/1999 | Bashista et al. |
| 5,933,885 | A | 8/1999 | Glassford |
| 5,937,458 | A | 8/1999 | Derosa |
| 6,012,189 | A | 1/2000 | Dudley |
| 6,019,421 | A | 2/2000 | Roh |
| 6,026,330 | A | 2/2000 | Chuang |
| 6,039,393 | A | 3/2000 | Roh |
| 6,055,690 | A | 5/2000 | Koenig |
| 6,089,947 | A | 7/2000 | Green |
| D433,851 | S | 11/2000 | Roh |
| 6,168,495 | B1 | 1/2001 | Yoon |
| 6,170,101 | B1 | 1/2001 | McCloud |
| 6,178,573 | B1 | 1/2001 | Wagner et al. |
| 6,243,895 | B1 | 6/2001 | Amin |
| 6,302,487 | B1 | 10/2001 | Fujita et al. |
| 6,315,364 | B1 | 11/2001 | Fujita et al. |
| 6,347,422 | B2 | 2/2002 | Heavrin |
| 6,421,857 | B2 | 7/2002 | Whatman et al. |
| 6,438,775 | B1 | 8/2002 | Koenig |
| 6,489,000 | B1 | 12/2002 | Ogura et al. |
| 6,550,083 | B1 | 4/2003 | Lamantia |
| 6,670,018 | B2 | 12/2003 | Fujita et al. |
| 6,701,555 | B1 | 3/2004 | Ermini |
| 6,760,935 | B1 | 7/2004 | Burton et al. |
| 6,772,457 | B1 | 8/2004 | Alaback |
| D532,640 | S | 9/2004 | Pressler |
| 6,859,962 | B2 | 3/2005 | Diak/Ghanem |
| 6,979,491 | B2 | 12/2005 | Yan et al. |
| 6,988,286 | B2 | 1/2006 | Schecter et al. |
| D517,698 | S | 3/2006 | Savage |
| 7,007,325 | B1 | 3/2006 | Gomeh |
| 7,055,192 | B2 | 6/2006 | Waters et al. |
| 7,523,513 | B2 | 4/2009 | Waters et al. |
| 8,572,779 | B2 | 11/2013 | Pratt et al. |
| 2001/0000362 | A1 | 4/2001 | Wagner et al. |
| 2002/0034901 | A1 | 3/2002 | Fujita et al. |
| 2002/0178500 | A1 | 12/2002 | Koenig |
| 2004/0128764 | A1 | 7/2004 | McGrath et al. |
| 2004/0199999 | A1 | 10/2004 | Landry |
| 2005/0132498 | A1 | 6/2005 | Vrionis |
| 2005/0177942 | A1 | 8/2005 | Finn et al. |
| 2005/0217030 | A1 | 10/2005 | Seigler |
| 2006/0010608 | A1 | 1/2006 | Defranks et al. |
| 2007/0246157 | A1 | 10/2007 | Mason |
| 2007/0261173 | A1 | 11/2007 | Schlussel |
| 2009/0049870 | A1 | 2/2009 | Garus |
| 2009/0083908 | A1 | 4/2009 | Fry |
| 2009/0106904 | A1 | 4/2009 | Swarts |
| 2010/0286910 | A1* | 11/2010 | Hudson ..... F21S 4/10 701/469 |
| 2011/0197818 | A1 | 8/2011 | Simon |
| 2015/0044429 | A1* | 2/2015 | Haimoff ..... B29D 28/00 428/175 |
| 2016/0101590 | A1* | 4/2016 | Kane ..... D21J 1/06 428/141 |

FOREIGN PATENT DOCUMENTS

| | | | |
|---|---|---|---|
| EP | 1378193 | A1 | 1/2004 |
| WO | 2004056237 | A2 | 7/2004 |
| WO | 2009034193 | A1 | 3/2009 |
| WO | 2010075294 | A1 | 7/2010 |

OTHER PUBLICATIONS

S. Munoz, Shopping Around/Antimicrobial Sheets, Wall Street Journal, Jan. 4, 2007.

Silver used by big business to make antimicrobial clothing, http://www.nanobiosilver.com/applications.html (Jul. 2008).

C. Gromer, "Smart Threads Today's Technology Driven Fabrics Coddle You While Battling the Elements", Popular Mechanics, pp. 78-81 (Apr. 2004).

* cited by examiner

PILLOW WITH GUSSET AND OPEN CELL CONSTRUCTION

CROSS-REFERENCE TO RELATED APPLICATION

This application is a continuation application of U.S. patent application Ser. No. 15/362,285, filed Nov. 28, 2016, entitled "PILLOW WITH GUSSET AND OPEN CELL CONSTRUCTION," which is a continuation application of U.S. patent application Ser. No. 14/698,411, filed Apr. 28, 2015, which is a continuation application of U.S. patent application Ser. No. 14/328,008 filed Jul. 10, 2014, which issued as U.S. Pat. No. 9,015,883 on Apr. 28, 2015, which is a continuation of U.S. patent application Ser. No. 14/107,665 filed Dec. 16, 2013, which issued as U.S. Pat. No. 8,887,332 on Nov. 18, 2014, which is a continuation of U.S. patent application Ser. No. 13/531,122, filed Jun. 22, 2012, which issued as U.S. Pat. No. 8,646,134 and claims priority to U.S. Provisional Patent Application No. 61/499,907 filed Jun. 22, 2011. The above-identified applications are incorporated herein by reference, in their entireties.

BACKGROUND OF THE INVENTION

1. Field of the Invention

The present invention relates to upper neck and head support in the form of a pillow for the human body.

2. Description of the Related Art

The use of a pillow made typically of a fabric cover stuffed with a compliant soft material is known in the prior art. Conventional pillows generally provide a soft cushion on which to place the head of an infant, child, or adult while resting or sleeping, either in bed, or on upholstered furniture in which case the pillows typically have a permanent fabric cover. Additionally, positional specific pillows have been heretofore devised and utilized for the purpose of supporting the head and neck of people.

SUMMARY OF THE INVENTION

A pillow is provided herein which includes a cover having opposing first and second panels. A gusset perimetrically bounds, and joins, the first and second panels. The gusset is formed of an open cell construction. Compliant fill material is disposed within the cover. Advantageously, with the subject invention, a pillow is provided allowing for lateral ventilation between opposing panels. This permits a cooling effect while a user is resting or sleeping.

An "open cell construction" as used herein refers to a construction having overall porosity greater than the inherent porosity of the constituent material or inherently having high porosity.

These and other features of the invention will be better understood through a study of the following detailed description and accompanying drawings.

DETAILED DESCRIPTION OF THE INVENTION

Figure 1:
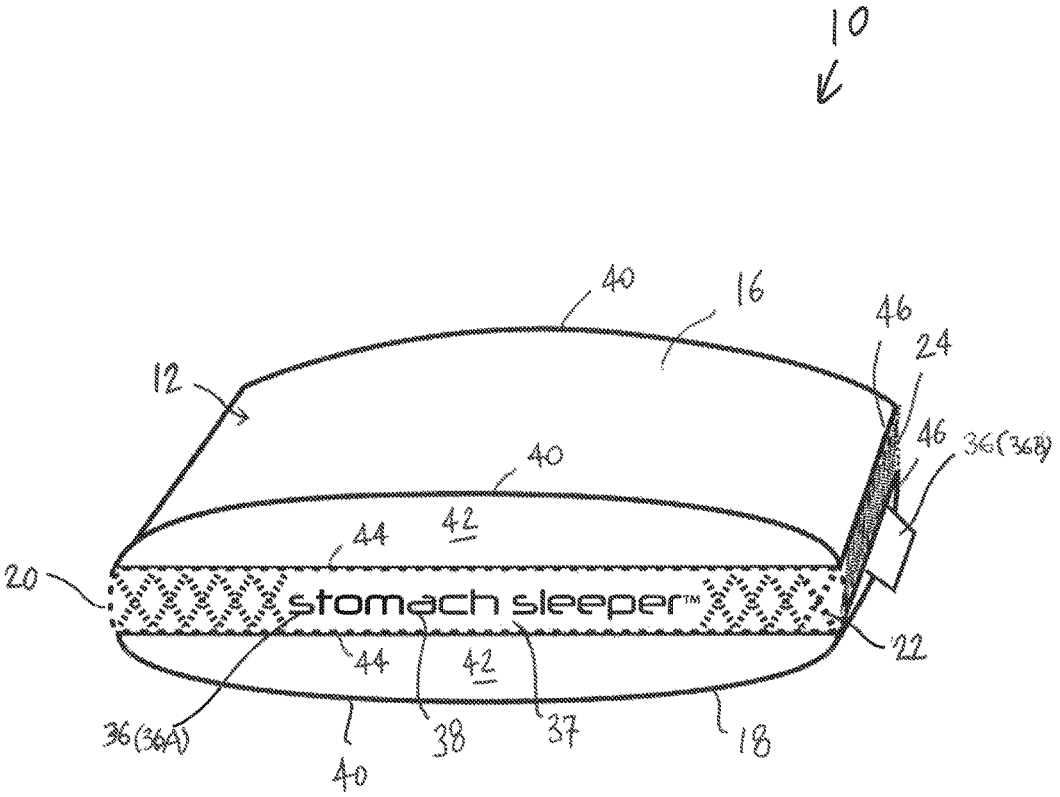
FIG. 1 is a perspective view of a pillow formed in accordance with the subject invention.

With reference to the Figures, a pillow 10 is provided having generally a cover 12 with compliant fill material 14 disposed therein. The cover 12 includes opposing first and second panels 16, 18 and a gusset 20 which perimetrically bounds, and joins, the first and second panels 16, 18, the gusset 20 being formed of an open cell construction. The first and second panels 16, 18 are sized and shaped to accept a user's head to provide support therefor.

The gusset 20 preferably is generally flat. In addition, it is preferred that the gusset 20 have sufficient width to separate the first panel 16 from the second panel 18 so as to define an air flow channel therethrough. This, thus, allows for an open cell construction band to be defined about the pillow 10 between the first and second panels 16, 18. With pressure and/or heat applied to one or both of the first and second panels 16, 18, the gusset 20 provides venting therethrough of the interior of the cover 12. The venting may enhance the comfort of a user. With the first and second panels 16, 18 preferably defining each a generally rectangular footprint common with the gusset 20, the gusset 20 is provided as four contiguous portions, including two longer longitudinal portions 22 joined by two shorter end portions 24.

Figure 3:
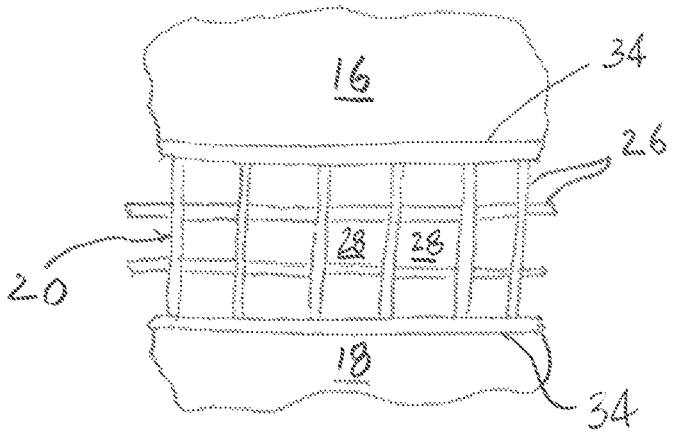
FIGS. 3-5 depict different open cell constructions useable with the subject invention.

The open cell construction of the gusset 20 may be defined by various constructions. With reference to FIG. 3, the gusset 20 may be defined by a plurality of interlaced or spaced-apart strands 26 arranged randomly or in various patterns, such as a "x" pattern (FIG. 1) or a rectangular pattern (FIG. 3). The strands 26 may be of various materials, including, e.g., polyester, and may be elastic or inelastic. The strands 26 are arranged so that open cells 28 are defined therebetween. The strands 26 may be connected at points of intersection (e.g., by fusion, stitching, being tied, by a fastener, and so forth) or may be not connected so as to permit free movement between contacting strands 26. If connected, it is preferred that the strands 26 be formed of elastic material. In addition, the strands 26 may be disposed in multiple layers so as to define a three-dimensional structure in a direction towards the interior of the pillow 10.

Figure 4:
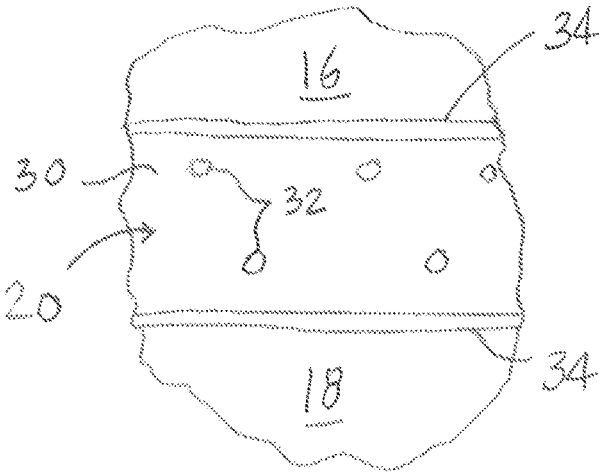

With reference to FIG. 4, the gusset 20 may be formed of a base material 30, which is preferably a textile, such as a polyester textile. Apertures 32 may be defined in the base material 30 with the apertures 32 defining the open cells of the gusset 20. The apertures 32 are larger in size than any pores that may be inherently defined in the base material 30. The apertures 32 may be formed during manufacture of the base material 32 or formed after manufacture, such as by cutting, or material removal from, the base material 30. The apertures 32 may be unfinished or finished, such as with trim or stitching. The base material 30 may be single or multi-ply.

Figure 5:
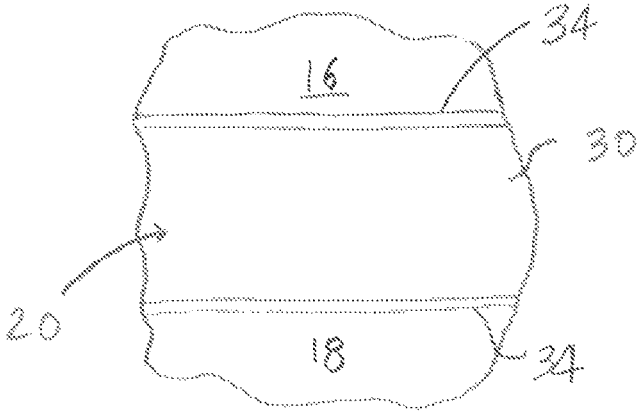

As a further variation, and with reference to FIG. 5, the gusset 20 may be formed with the base material 30 being inherently significantly porous. Preferably, the base material 30 is formed of 3D spacer fabric, which is inherently highly porous. More preferably, the base material 30 is formed of polyester 3D spacer fabric. The pores of the base material 30 may be formed with irregular or regular shapes, such as circle-like or polygon-like shapes (e.g., diamond-like shapes). The porosity of the base material 30 may be substantially greater than the porosity of the material forming the first panel 16 and/or substantially greater than the porosity of the material forming the second panel 18. "Substantially greater" refers to being at least greater than, but preferably being at least twice greater than. The base material 30 may be single or multi-ply. If multi-ply, the collective porosity of the base material 30, through all layers. is considered as being substantially greater than the porosity of the material of either the first panel 16 or the second panel 18.

The gusset 20 may include one or more of the open cell configurations described above in connection with FIGS. 3-5 singularly or in any combination.

The gusset 20 may be joined to the first and second panels 16, 18 using any conventional technique, including being sewn together. To provide the pillow 10 with a robust construction, it is preferred that piping 34, or other reinforcing material and/or stitching, be provided at the points of connection between the gusset 20 and each of the first and second panels 16, 18.

One or more labels 36 may be provided with the pillow 10 to indicate the intended use of the pillow 10, and/or to provide additional or explanatory information regarding the pillow 10. For example, with reference to FIG. 1, the label 36 may be in the form of banner 36A which may be a strip of textile, e.g., satin, having indicia 38 thereon, e.g. by embroidery, with the banner 36A being secured to a portion of the pillow 10. Preferably, the banner 36A with the indicia 38 thereon is located over a portion of the gusset 20. The banner 36A is preferably attached along one of its faces so as to have one face 37 exposed with the indicia 38 thereon. This allows for easy visual recognition of information related to the pillow 10, such as an intended purpose of the pillow, even with a plurality of the pillows 10 being stacked. The label 36 may be also in the form of tag 36B which may be in the form of one or more individual pieces of sheet material (e.g., paper and/or textile) which is affixed to the pillow 10 in any known technique, such as by sewing, gluing, mechanically fastening, and so forth. The tag 36B may include printed, or otherwise provided thereon, information, such as care and/or allergy information. The tag 36B may be secured at a seam in the cover 12, such as along the connection between one of the first and second panels 16, 18 and the gusset 20. The tag 36B is preferably attached along one of its edges so as to have both faces viewable.

The indicia 38, without the banner 36A, may be directly affixed to the pillow 10, such as by embroidery, printing or other marking. For example, the indicia 38 may be directly affixed to the gusset 20, such as by embroidery. With direct application of the indicia 38 to the gusset 20, the ability to pass air through the gusset 20 is minimally impacted.

Different fill materials 14 are possible for the pillow 10. The fill material may be blends of hypoallergenic polyester fibers to achieve different levels of support versus softness as described above. For example, with the pillow 10 being intended for a stomach sleeping position, the pillow 10 may be provided with a fill of microfiber; with the pillow 10 being intended for a back sleeping position, the pillow 10 may be provided with a fill of a blend of conjugate and hollow slick fiber; and, with the pillow 10 being intended for a side sleeping position, the pillow 10 may be provided with a fill of cluster/ball fiber. As will be appreciated by those skilled in the art, other fills are possible. Various down, memory foam (solid layer(s) and/or clusters) and/or latex (solid layer(s) and/or springs), in varying combinations, may be utilized with the pillow 10 herein. The indicia 38 may be provided to indicate the intended sleep position of the pillow 10 based on the fill material therein.

Figure 2:
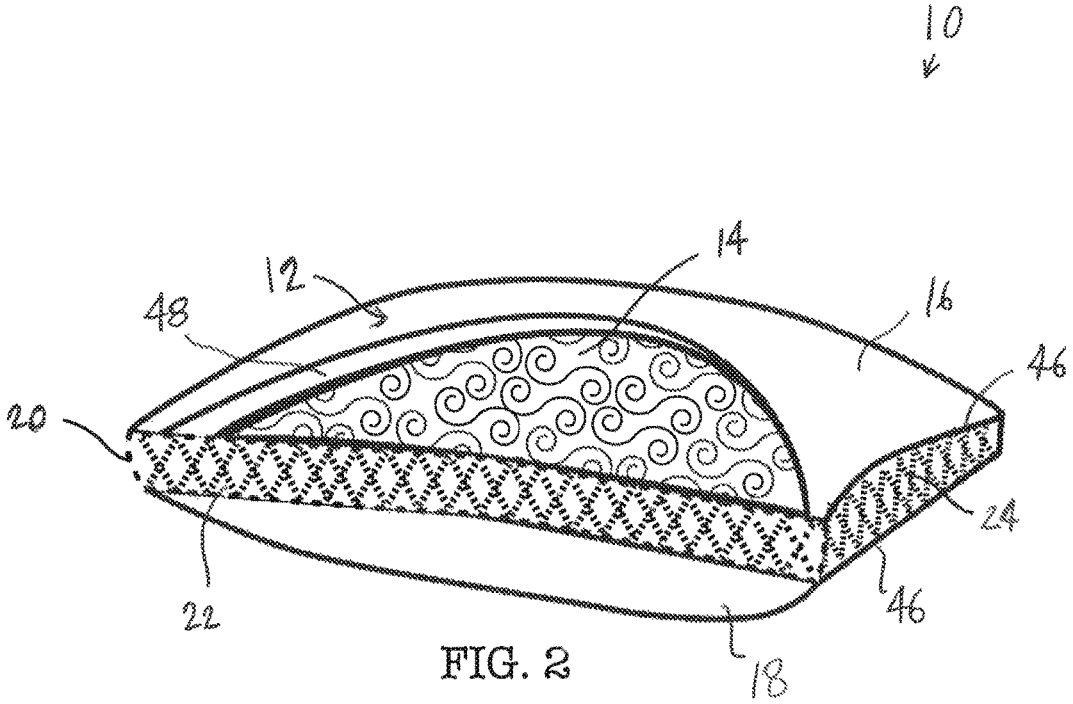
FIG. 2 is a partial cut-away view of the pillow of FIG. 1.

The pillow 10 may be of various configurations. In a preferred embodiment, the pillow 10 is provided with increased height at central portions, as shown in FIGS. 1 and 2. The fill material 14 is configured to provide the desired shape. More preferably, the first and second panels 16, 18 may be arcuately bowed-out in opposing directions (e.g., being convexly arc-shaped in opposing directions). Preferably, top edges 40 of the first and second panels 16, 18 are generally straight and parallel as viewed in a direction perpendicular to the first and second panels 16, 18. The top edges 40 may be parallel to the longitudinal portions 22 of the gusset 20. An area 42 may be defined between and be bounded by the top edge 40 and the longitudinal portion 22 on opposing sides of each of the first and second panels 16, 18. The areas 42 are preferably flat and coplanar with the corresponding top edge 40 and longitudinal portion 22.

The first and second panels 16, 18 each preferably include bottom edges 44, each extending along the bottom of one of the areas 42, and end edges 46. The bottom edges 44 extend between the end edges 46 so as to define a generally rectangular profile. The gusset 20 is preferably attached to the first and second panels 16, 18 along the rectangular profiles of the bottom edges 44/end edges 46 of the first and second panels 16, 18.

The present invention provides the correct alignment to head and neck area for the specific position of the user (back, stomach or side) while at the same time creating an environment of cooling and airflow, which allows the sleeper to maintain their body temperature, and spine alignment, which encourages a normal sleep cycle.

To enhance the cooling effect, it is preferred that an inner cover 48 be provided, located inside the cover 12, in which the fill material 14 is disposed. Preferably, the inner cover 48 is relatively resistant to air flow therethrough, such as being formed by one or more layers of non-woven material (e.g., 100% polyester). The inner cover 48 may be formed of spandex or a spandex blend, such as polyester/spandex; although less resistance to air flow therethrough is provided by spandex or a spandex blend as compared to non-woven material, the spandex or spandex blend provides greater elasticity than the non-woven material which may provide greater comfort to a user. The inner cover 48 acts as a barrier against air flow into the fill material 14. With the gusset 20 being of open cell construction, air exchange about the inner cover 48 is permitted. This allows for heat dissipation and minimal heat collection within the pillow 10. In addition, because the inner cover 48 acts as an air barrier during use, heat transfer by air flow into the fill material 14 may be reduced.

The first panel 14 and/or the second panel 18 may be formed of various materials particularly various textiles. Preferably, the first panel 14 and/or the second panel 18 is formed of a moisture-wicking fabric, such as 100% polyester fabric, rayon, nylon, or spandex-blend fabric for increased performance and stretch-ability, which allows for moisture dispersion and, thus, heat management to cool the head and body. A cooling material, such as a gel, may be applied interiorly to the front panel 14 and/or the second panel 18. The cooling material may be silicon or polyether gel formed into layers and applied shapes, as well as, formed ceramics, neoprene and other material technology as developed and available for use to perform heat transfer and temperature regulation function. Depending on the nature and stability of the cooling material, the cooling material may be applied internally and/or externally to the front panel 14 and/or the second panel 18.

In an alternative embodiment, the first panel 14 and/or the second panel 18 may be partially or wholly formed with open cell construction. Any of the open cell constructions discussed above may be utilized. The first panel 14, the second panel 18 and/or the gusset 20 may use the same or different open cell configurations in various combinations. The first panel 14, the second panel 18 and/or the gusset 20 may be provided with different visual appearances (e.g., different colors, patterns, etc.) in various combinations.

Figure 6:
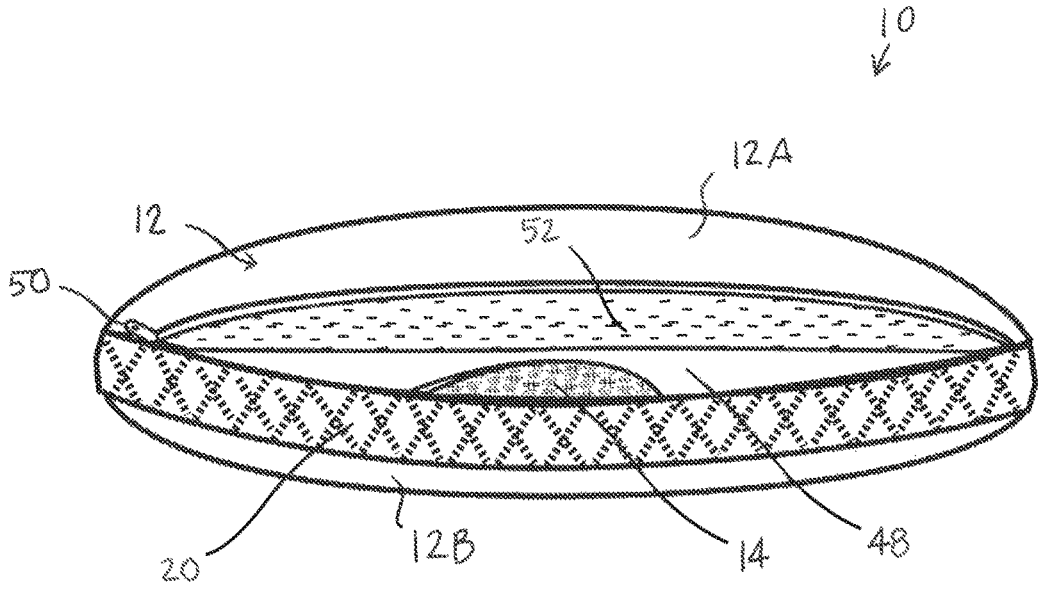
FIG. 6 is a perspective view of a pillow formed in accordance with the subject invention have a cover with separable portions; and, FIG. 7 is a perspective view of a foam layer useable with the subject invention.

To allow fix washing of the cover 12, the cover 12 may be formed by at least two partially or wholly separable portions 12A, 12B, as shown in FIG. 6. By separating the separable portions 12A, 12B, the cover 12 may be removed from the fill material 14, and the inner cover 48, if used. Preferably, the cover 12 is separated along at least one of the longitudinal portions 22 of the gusset 20 and possibly along portions of one or both of the end portions 24 and/or along the other of the longitudinal portions 22. One or more fasteners 50 may be provided to selectively join the separable portions 12A, 12B. The fastener(s) 50 is preferably a zipper, but may also include buttons, snaps, hook-and-pile fasteners, and so forth.

Figure 7:
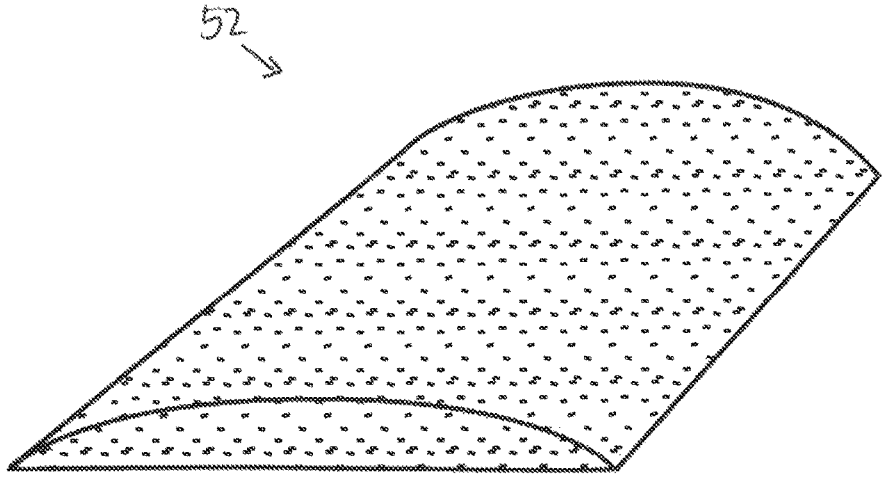

With the inner cover 48 being used, it is preferred that all of the fill material 14 be located therein. In an alternative embodiment, as shown in FIG. 6, a portion of the fill material 14 may be located outside of the inner cover 48 within the cover 12. If a portion of the fill material 14 is located outside of the inner cover 48, it is preferred that the fill material 14 include one or more solid foam layers 52 located between the cover 12 and the inner cover 48. In a preferred arrangement, the same number of similarly configured (shape, material) solid foam layers 52 are located on both sides of the inner cover 48. As shown in FIG. 7, the solid foam layers 52 may be shaped to impart overall shape to the pillow 10. Preferably, the solid foam layers 52 have an arcuate profile to impart an outwardly-bowed shape to the first and second panels 16, 18.

What is claimed is:

1. A pillow comprising:

a cover having opposing first and second panels, and a gusset perimetrically bounding, and joining, the first and second panels;

an inner cover located inside the cover, the cover having a porosity that is greater than a porosity of the inner cover; and a fill material disposed within the inner cover.

2. A pillow as recited in claim 1, wherein the inner cover acts as a barrier against air flow into the fill material.

3. A pillow as recited in claim 1, wherein the inner cover reduces heat transfer by air flow into the fill material.

4. A pillow as recited in claim 1, wherein the pillow permits air exchange about the inner cover.

5. A pillow as recited in claim 1, wherein the inner cover maintains an air gap created by the gusset by restricting movement of the fill material and preventing the fill material from filling the air gap.

6. A pillow as recited in claim 1, wherein the inner cover is relatively resistant to air flow therethrough.

7. A pillow as recited in claim 1, wherein the inner cover is formed by one or more layers of non-woven material.

8. A pillow as recited in claim 7, wherein the non-woven material is polyester.

9. A pillow as recited in claim 1, wherein the inner cover is formed of spandex.

10. A pillow as recited in claim 1, wherein the inner cover is formed of a spandex blend.

11. A pillow as recited in claim 1, wherein the cover may be removed from the fill material and the inner cover.

12. A pillow as recited in claim 1, wherein all of the fill material is located in the inner cover.

13. A pillow as recited in claim 1, wherein the fill material defines a core having a rectangular footprint.

14. A pillow as recited in claim 1, wherein the fill material is configured to provide the pillow with a rectangular footprint.

15. A pillow comprising:

a cover having opposing first and second panels, and a gusset perimetrically bounding, and joining, the first and second panels;

an inner cover located inside the cover, the inner cover being formed by one or more layers of non-woven material such that the inner cover is relatively resistant to air flow therethrough, the panels each having a porosity that is greater than a porosity of the inner cover; and a fill material disposed within the inner cover.

16. A pillow as recited in claim 15, wherein the inner cover acts as a barrier against air flow into the fill material.

17. A pillow as recited in claim 15, wherein the inner cover reduces heat transfer by air flow into the fill material.

18. A pillow as recited in claim 15, wherein the pillow permits air exchange about the inner cover.

19. A pillow as recited in claim 15, wherein the inner cover maintains an air gap created by the gusset by restricting movement of the fill material and preventing the fill material from filling the air gap.

20. A pillow comprising:

a cover having opposing first and second panels, and a gusset perimetrically bounding, and joining, the first and second panels;

an inner cover located inside the cover, the inner cover being formed by one or more layers of non-woven polyester such that the inner cover is relatively resistant to air flow therethrough, the cover having a porosity that is greater than a porosity of the inner cover; and a fill material disposed within the inner cover such that the fill material provides the pillow with a rectangular footprint, wherein the cover may be removed from the fill material and the inner cover.

* * * * *